United States Patent [19]

Rader

[11] Patent Number: 5,063,859

[45] Date of Patent: Nov. 12, 1991

[54] DOUBLE-LEVEL RAILROAD CAR HAVING A FLAT CENTER SILL

[76] Inventor: Thomas G. Rader, 7708 89th Pl. SE., Mercer Island, Wash. 98040

[21] Appl. No.: 255,068

[22] Filed: Oct. 7, 1988

[51] Int. Cl.[5] ..... B61D 1/00

[52] U.S. Cl. ..... 105/340; 105/344; 296/215

[58] Field of Search ..... 105/327, 331, 340, 397, 105/344, 345; 296/146, 178, 210, 215; 49/36; D12/84, 183, 40, 195; D25/52; 52/86

[56] References Cited

U.S. PATENT DOCUMENTS

| | | | |
|---|---|---|---|
| D. 169,938 | 6/1953 | Girardy et al. | D66/1 |
| D. 171,258 | 1/1954 | Kay | D66/1 |
| D. 208,595 | 9/1967 | Cripe | D12/36 |
| D. 236,967 | 9/1975 | Armstrong et al. | D12/84 |
| D. 236,968 | 9/1975 | Armstrong et al. | D12/84 |
| D. 301,704 | 6/1989 | Groves et al. | D12/40 |
| 471,340 | 3/1892 | Boynton | 105/340 X |
| 509,325 | 11/1893 | Pope | 105/340 |
| 846,847 | 3/1907 | Harris | 105/327 |
| 2,088,655 | 8/1937 | King | D12/40 |
| 2,281,581 | 5/1942 | Horton | 105/327 |
| 2,596,309 | 5/1952 | Urich | 296/215 X |
| 2,633,090 | 3/1953 | Murphy | 105/340 |
| 2,811,932 | 11/1957 | Clary | 105/340 |
| 3,503,340 | 3/1970 | Warren | 105/340 |
| 3,892,188 | 7/1975 | Warren | 105/368 R |
| 3,971,455 | 7/1976 | Molzon | 296/178 X |
| 4,596,093 | 6/1986 | Esposito | 52/86 |
| 4,601,139 | 7/1986 | Esposito | 52/90 |
| 4,671,027 | 6/1987 | Esposito | 52/86 |
| 4,723,386 | 2/1988 | Sandow | 52/200 |

*Primary Examiner*—Robert J. Oberleitner
*Attorney, Agent, or Firm*—Seed and Berry

[57] ABSTRACT

A railroad car having an upper and lower level is disclosed. The lower level is positioned above a flat center sill extending along the length of the car and supported above the axles of the wheels at either end of the car. The upper level is positioned vertically above the lower level. Each of the levels includes doorways opening to the floor region of the respective levels. Having a doorway at each level permits a freer flow of passenger and railroad service personnel traffic between railroad cars. The upper level includes an observation deck having an integral window member which has a substantially vertical portion, a curved portion, and a generally horizontal portion. The shape of the duct system ensures that forced air is evenly distributed along the car.

18 Claims, 7 Drawing Sheets

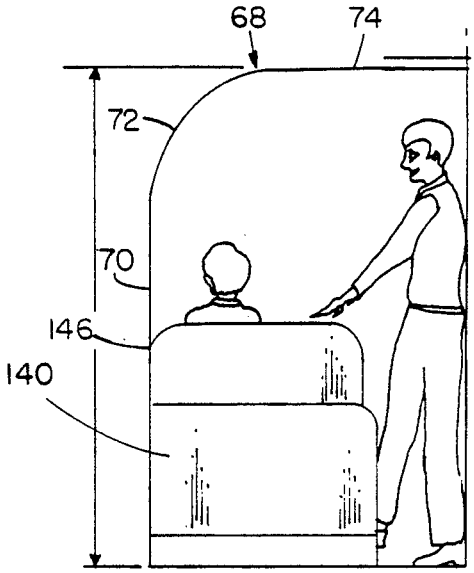
FIG. 7
FIG. 2
PRIOR ART
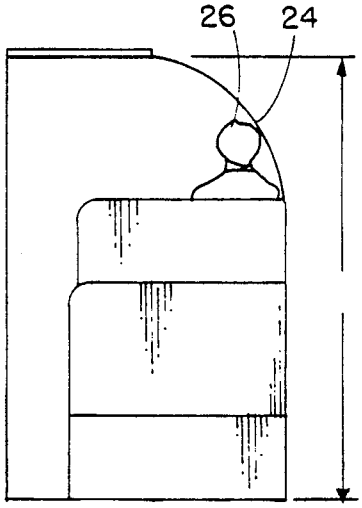
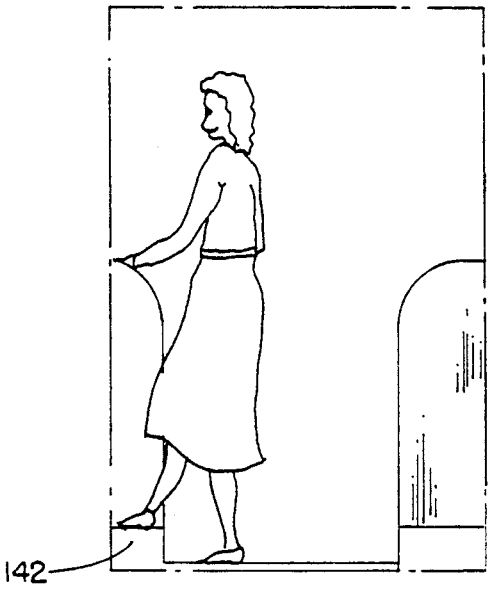
FIG. 8
FIG. 3
PRIOR ART
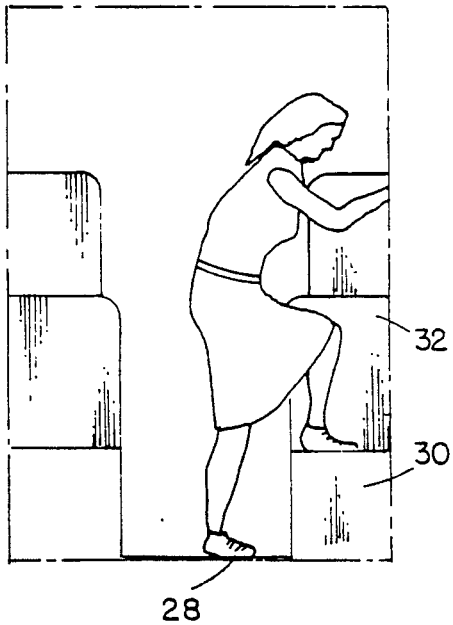

FIG. 4
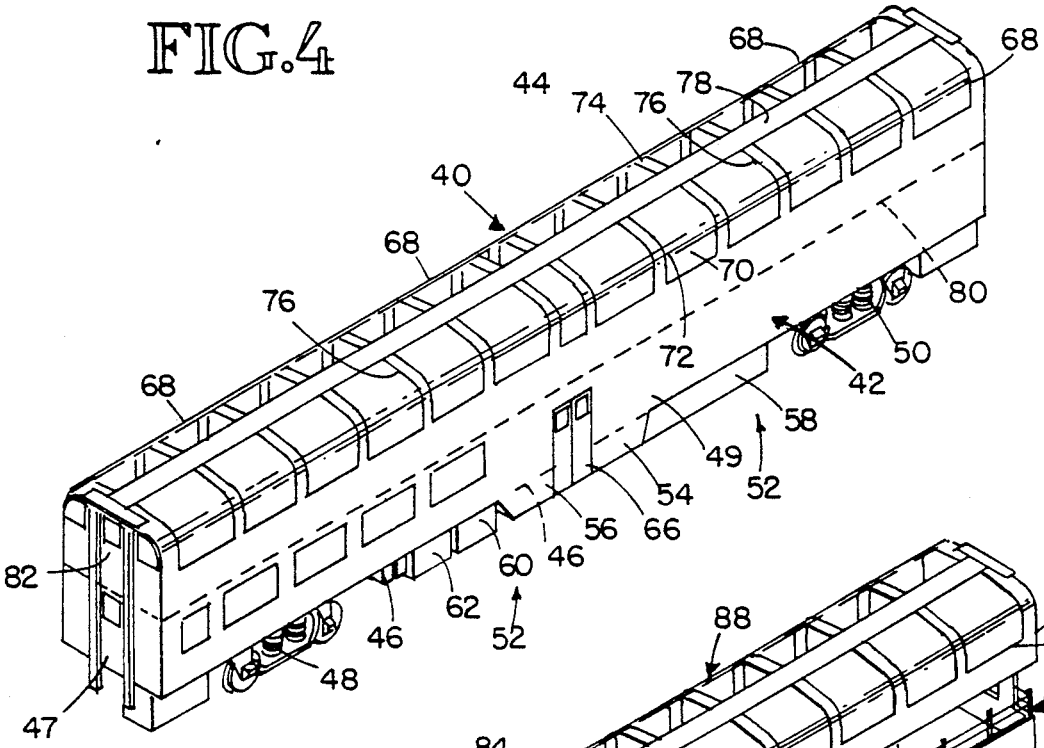
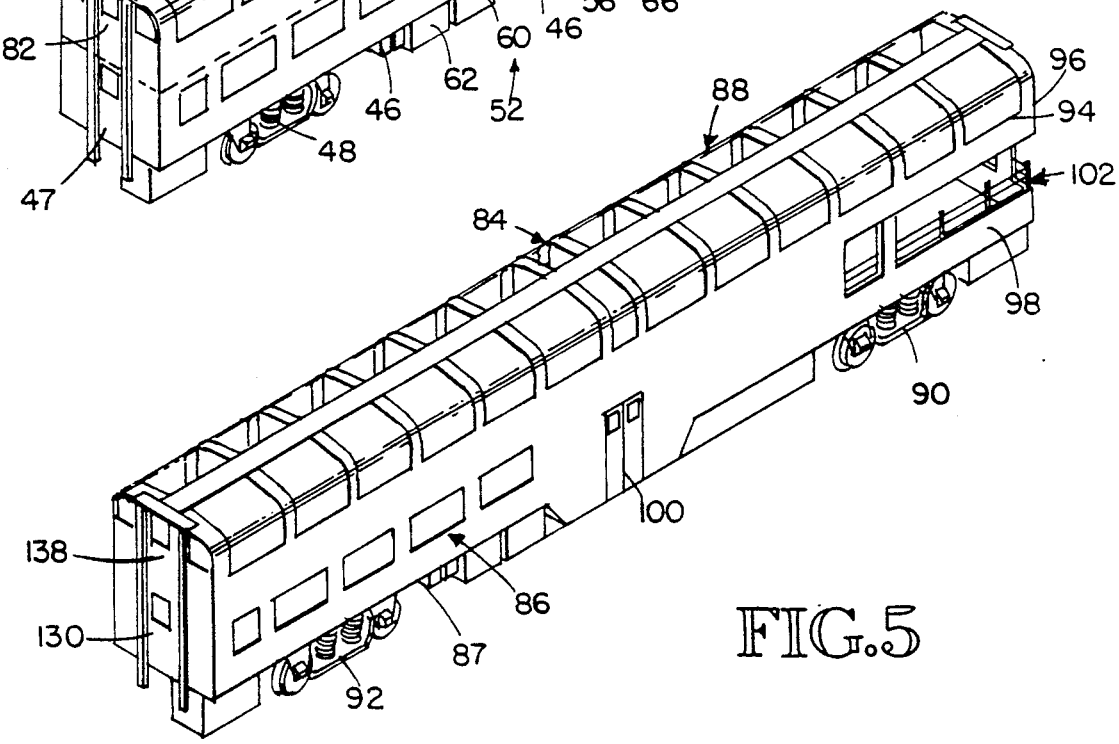
FIG. 5

DOUBLE-LEVEL RAILROAD CAR HAVING A FLAT CENTER SILL

FIELD OF THE INVENTION

This invention relates to passenger railroad cars, and more particularly, to double-level cars having an observation deck on the upper level.

BACKGROUND OF THE INVENTION

Passenger railroad cars previously constructed have included dining areas and lounging areas. Some railroad cars have been constructed having two levels of seats, a first, lower level of seats and a second, upper level of seats. The lower level may also include a kitchen, restroom or other service area. The dining area is frequently in the lower level. The second, upper level is frequently provided with large, curved viewing windows, permitting the upper level to function as an observation deck The two levels of the prior art railroad cars were provided by positioning the first, lower level between the wheels of the railroad car. The lower level's length is limited to the distance between the wheels of the railroad cars. The kitchen and other service areas either were located in different cars or, if in the same car, were in a very cramped space in the lower level between the wheels with the dining area. In the area directly above the wheels, only a single level of passenger seats was provided. Further, at the end of the car, a single doorway was provided to permit the passengers to exit or enter the railroad car. A significant disadvantage of having only a single doorway at each end of the railroad car is that both passengers and service personnel must use the same door to enter or exit car. When a meal is being served or service personnel are moving from one car to another, it is impossible for the passengers to also move from one car to another. This significantly decreased the enjoyability of passenger travel by railroad car.

Frequently, the mechanical equipment, such as the air conditioning, heating, compressors and the like, were positioned directly above the wheels but below the upper level.

SUMMARY OF THE INVENTION

It is an object of this invention to provide a railroad car having passageways at both the lower and upper levels.

It is another object of this invention to provide the passengers in the upper level of a railroad car a greater view of the passing scenery than previously possible.

It is another object of this invention to provide an open platform area towards the rear of a car and a full passenger riding area, with seats, above the platform area.

It is another object of this invention to provide an improved air-conditioning system which uniformly distributes forced air along the entire railroad car.

These and other objects of the invention are accomplished by providing a railroad car having a flat center sill extending horizontally above the wheels. A first level extends substantially horizontally along the entire length of the car, with a passageway out of the end of the car from the lower level. An upper level extends substantially along the entire length of the car, with a passageway out of the same end of car from the upper level. The railroad car includes a forced-air duct extending along the railroad car, the duct having a gradually decreasing cross-sectional area extending away from the fan. The gradually decreasing cross-sectional area ensures that a uniform quantity of air exits from the vents spaced along the entire length of the duct.

The upper level of the railroad includes passenger seats positioned on the floor. An integral transparent member having a vertical portion, a curved portion, and a generally horizontal portion forms a portion of the sidewall and ceiling wall. The large, transparent member provides significantly greater viewing of the passing scenery and a more spacious feeling than previously possible in railroad cars. The mechanical equipment, such as the air compressors, air conditioners and heaters, are located below the lower level of seats, between the wheels of the railroad car.

Providing two passageways into or out of the railroad car, one located directly above the other at the same end of the car, permits the passengers to use the passageway of the upper level and the service personnel to use the passageway of the lower level. Providing a seating area above the open platform area significantly increases the number of passengers that can ride on the railroad car and have an enjoyable view of the scenery. Providing an integral transparent viewing member which is generally vertical for a portion thereof provides a significantly increased view by the passengers and a more spacious feeling.

BRIEF DESCRIPTION OF THE DRAWINGS

FIG. 2 is a partial cross-sectional view of a seat and window in the upper level of a prior art railroad car.

FIG. 3 is a partial cross-sectional view of a center aisle and seat of the prior art railroad car.

FIG. 4 is an isometric view of a two-level railroad car made according to the present invention.

FIG. 5 is an isometric view of a two-level railroad car, with an open platform, made according to the present invention.

FIG. 7 is a partial cross-sectional view of the seat and window of the upper level of the railroad car according to the present invention.

FIG. 8 is a side elevational view of the aisle and seat of the upper level of the railroad car according to the invention.

DETAILED DESCRIPTION OF THE INVENTION

Figure 1:
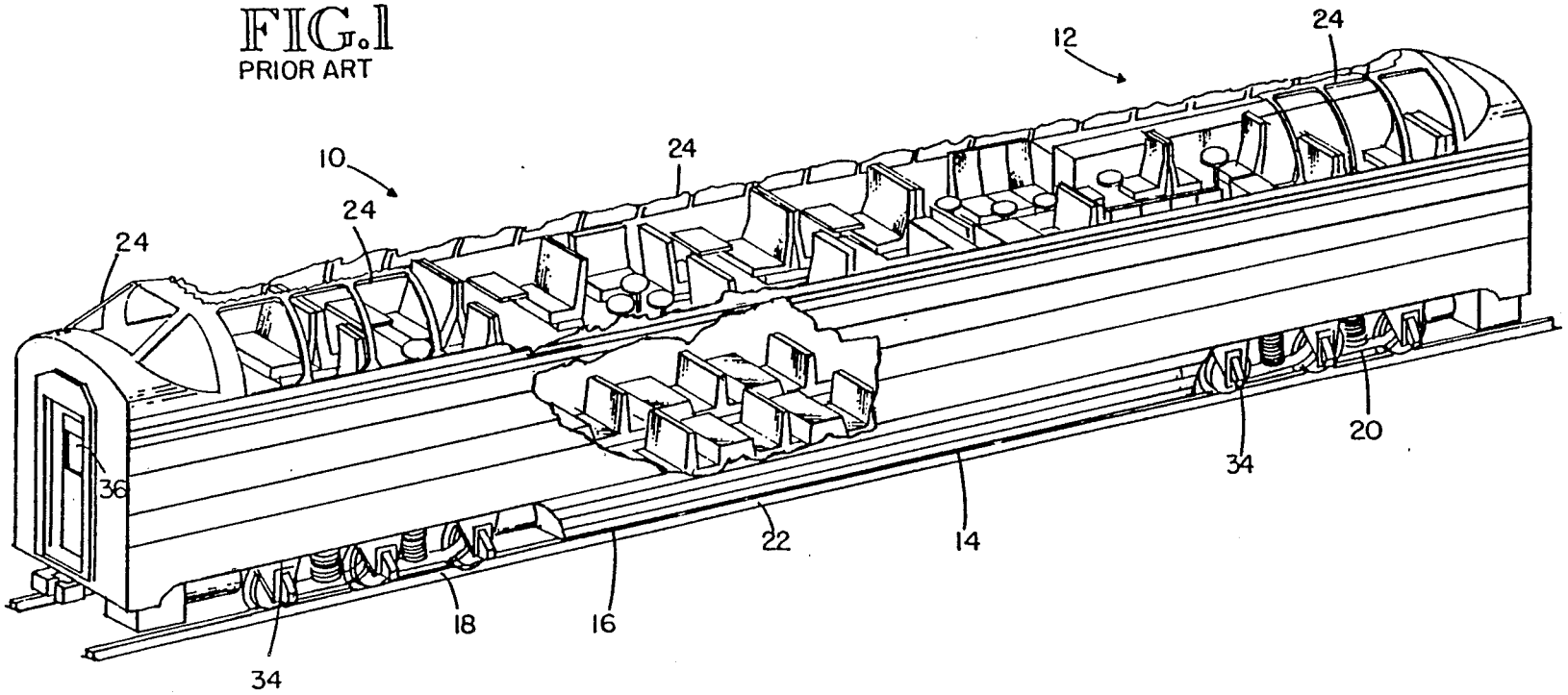
FIG. 1 PRIOR ART
FIG. 1 is an isometric view of a passenger railroad car of the prior art.

A passenger railroad car 10 having an upper level 12 and a lower level 14 as is known in the prior art is illustrated in FIG. 1. The railroad car 10 has depressed center sill 16. The depressed center sill is located between the front wheels 18 and the rear wheels 20 of the railroad car 10. The floor of the depressed center sill is located directly above the railroad tracks 22 and is in the same general plane as the axles of the wheels 18 and 20. Because the lower level 14 is located between the wheels 18 and 20, the length of the lower level is limited to the distance between the wheels. Generally, the dining room is located on the lower level 14. The kitchen may also be located within the same car 10 as the dining room 14. With the kitchen and the dining room both located on the lower level in the depressed center sill region 16, they must be made extremely compact, creating some discomfort for the passengers and the kitchen service personnel. The upper level 12 of the prior art railroad cars may include an observation deck having viewing windows 24 through which the passengers may view the scenery. The viewing windows 24 are curved with a constant radius for their entire length, as shown in FIG. 2. Having the windows 24 curved at a constant radius permits them to be easily manufactured; however, the window is relatively close to a passenger's head 26 as it curves inward, causing some discomfort to the passenger. A further disadvantage of the upper levels of current railroad cars is the necessity of the passenger to step up from the center aisle 28 over a large step 30 onto the seat 32, as can be seen from FIG. 3. The step 30 is frequently greater than one foot in height in railroad cars made according to the prior art. Step 30 must be made large to permit mechanical equipment, forced-air ducts, and other service machines of the railroad car to fit within the railroad car 10. The mechanical equipment is also stored in an intermediate level 34 located directly above the wheels 18 and 20 but below the upper level 12. The area 34 directly above the wheels is so short in height that passengers cannot comfortably sit or walk therein at two different levels, and therefore the aisle must be a combined aisle for both levels, with the space on either side thereof being used for baggage storage, mechanical equipment systems, and the like.

The railroad car 10 of the prior art has a doorway 36 at an end of the car through which passengers may enter another car coupled to the train. The single doorway 36 services both the upper and lower levels, there being respective stairways to the upper and lower levels near the end of the car. The single doorway 36 is used by the passengers as they move from one car to another as the train travels along the tracks. The same doorway must also be used by the conductor, cooks, waitresses, and other service personnel employed by the railroad. In the event the kitchen is located in a car other than the dining room car, food must be carried through the doorway and into the dining room. As passengers travel to and from the dining room at the same time that service personnel are moving to and from the dining room, some crowded conditions and traffic jams may occur.

A railroad car 40 made according to the present invention overcomes many of the disadvantages and shortcomings of the prior art railroad car 10. The railroad car 40 has a lower level 42 and an upper level 44. The frame of the railroad car 44, according to the present invention, has a flat center sill 46 extending generally horizontally along the entire length of the railroad car. The flat center sill 46 is supported at support points located above the axles of wheels 48 and 50.

The main floor 49 of the lower level of the car is located above the frame center sill. The majority or all the tables, seats, kitchen area, and other passenger occupation areas of the railroad car are located on the main floor, above the center sill. The lower level 42 includes a doorway 47 at one end of the railroad car which opens into the floor region of the lower level. The doorway 47 is greater than 24 inches in width and greater than 70 inches in height to permit a passenger and service personnel to easily enter and exit the railroad car through the doorway 47. Passengers and service personnel may enter and exit the railroad car through the doorway 47 at the end of the railroad car.

The mechanical equipment for the railroad car is located below the center sill in the depressed area between the wheels 48 and 50. The mechanical equipment 52 includes air-conditioning units 54 and 56, waste receptacle unit 58 coupled to the bathrooms, and various hydraulic pumps, electric motors, and other necessary mechanical devices, labeled generally as 60 and 62, as required for the railroad car.

A stairwell entrance 64 descends below the center sill to a doorway 66 through which passengers enter and exit the railroad car. The passengers may easily step onto the railroad car at the depressed center region and walk up the stairs to the main floor level 49, which is above the center sill 46.

The railroad car 40 includes an upper level 44 located vertically above the lower level and extending substantially identically in length to the lower level. The upper level 44 includes a floor region 80 extending generally horizontally along the entire length of the car 40. Doorway 82 at the end of the car 40 opens into the floor level 80 of the upper level 44. Passengers may exit or enter the upper level 44 through doorway 82 as desired. The doorway 82 is greater than 24 inches in width and greater than 70 inches in height to permit passengers to easily pass through the doorway. The upper level 44 is an observation deck from which the passengers may comfortably view the passing scenery. The observation deck 44 includes a transparent viewing member 68, preferably a glass panel, though platic or other transparent materials may be used, through which the passengers may look. The transparent member 68 includes a vertical portion 70, a curved portion 72, and a generally horizontal portion 74. The vertical portion 70 forms a portion of the sidewall, and the horizontal portion 74 forms a portion of the ceiling. Window support members 76 provide support along the edges of the glass, and central support member 78 provides support in the ceiling region.

The lower level 42 and upper level 44 of railroad car 40 each have respective doorways 47 and 82 at the same end of the railroad car. The doorways 47 and 82 are located vertically in line with each other, the doorway 47 being directly below the doorway 82. The doorways 47 and 82 are separate and distinct doorways from each other, the floor 80 and frame of the car 40 separating the doorways. The respective doors of the doorways may be closed or opened independently of each other as desired. Further, the doors may be used at the same time by individuals at the lower or upper level, permitting freer flow of traffic than previously possible with only a single level of doorway at the end of the railroad car.

Figure 12:
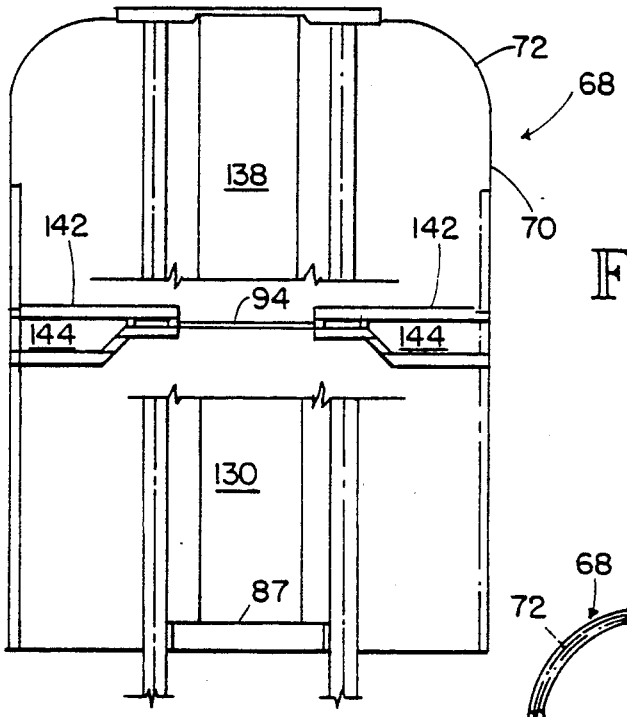
FIG. 12 is an end elevational view of a railroad car showing upper and lower passageways according to the invention.

Platform railroad car 84 is similar to kitchen and dining railroad car 40 in that it has a lower level 86 and an upper level 88, the lower level 86 having a floor region 87 extending generally horizontally on a center sill supported above the axles of the wheels 90 and 92. The lower level 86 includes a doorway 130 at the end which couples to railroad car 40 opening into the floor region 87. The upper level 88 of car 84 is similar to the upper level 44 of car 40. Namely, the upper level 88 includes a floor 94 and a doorway 138 at one end thereof, the doorway opening into the floor region 94 as shown in FIG. 12. The two doorways are at the end of the railroad car which is coupled to railroad car 40 to permit the doorway of railroad car 84 to line up with the doorways of railroad car 40 to form common passageways between railroad cars 40 and 84 at the floor region of the lower and upper levels of the respective cars. The observation area of car 84 extends the entire length of the car and includes rear windows 96. The platform car 84 is generally located as the last car in the railroad through which passengers may view the passing scenery.

The lower level 86 includes an open platform area 98 located generally at the rear of the car. The observation area of the upper deck 88 extends above the platform area 98 of the lower level 86. The open platform area 98 includes a floor region 100 which is in common with the floor region 87 of the remainder of the lower level of the railroad car 84. The open platform area 98 includes an open-air viewing area 102. The platform 98 is open to the air and passengers standing therein may view the passing scenery as well as smell the fragrances and feel the wind in their faces as the train travels. The platform area 98 is relatively large compared to other sections of the car. In one embodiment, the platform area 98 extends up to twenty percent of the entire length of the car, providing a significant open-air section where passengers may stand. In one embodiment, the open platform area 98 extends for over 20% of the length of the railroad car 84.

Figure 6:
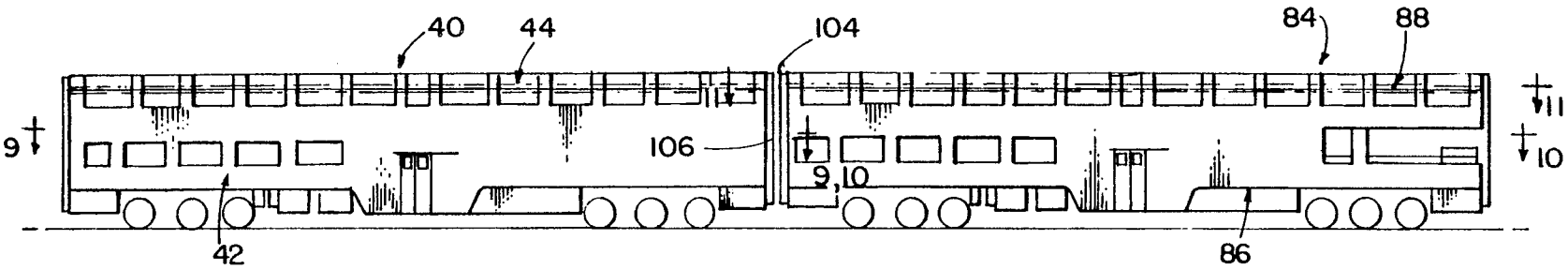
FIG. 6 is a side elevational view of the railroad cars of FIGS. 4 and 5 coupled together.

Railroad cars 40 and 84 are coupled together to form a two-railroad car combination, as shown in FIG. 6. When the railroad cars 40 and 84 are coupled together, a passageway between the respective floor regions of the cars is formed at the upper level. A passageway 106 is also formed at the lower level, between the respective lower floor regions of the railroad cars. The passageways are located vertically in line with each other, permitting independent use of the passageways by the passengers and service personnel of the railroad car.

Figure 11:
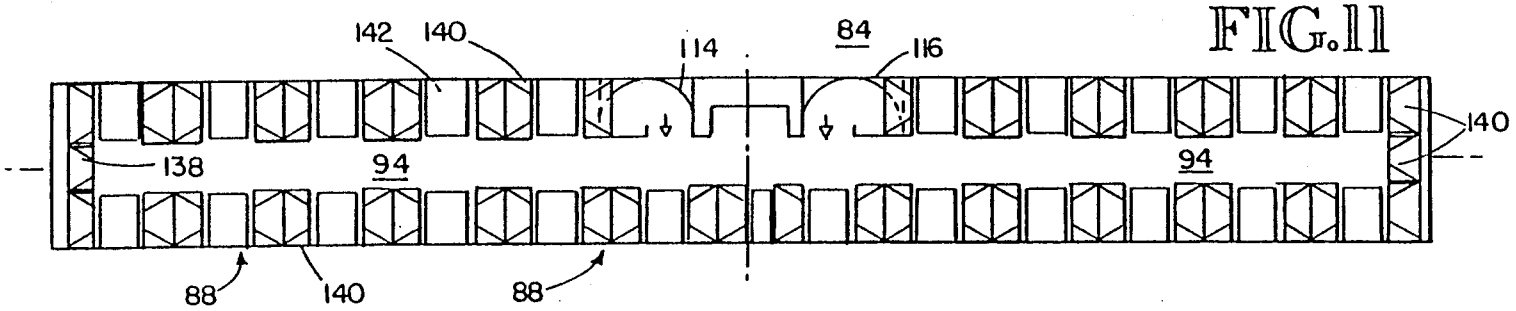
FIG. 11 is a cross-sectional view taken along lines 11—11 of FIG. 6 of the upper level of a railroad car according to the present invention.
Figure 10:
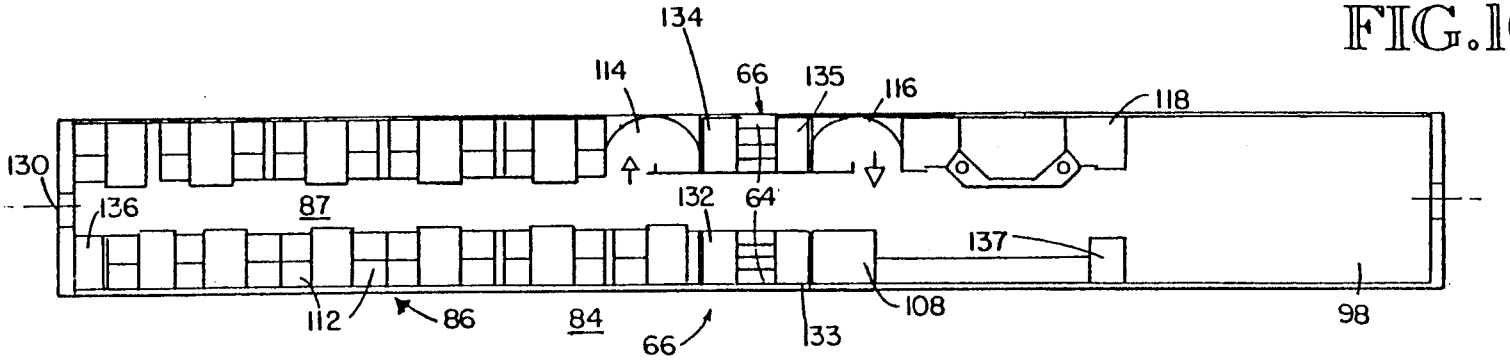
FIG. 10 is a cross-sectional view taken along lines 10—10 of FIG. 6 of the platform and dining car of the present invention.
Figure 9:
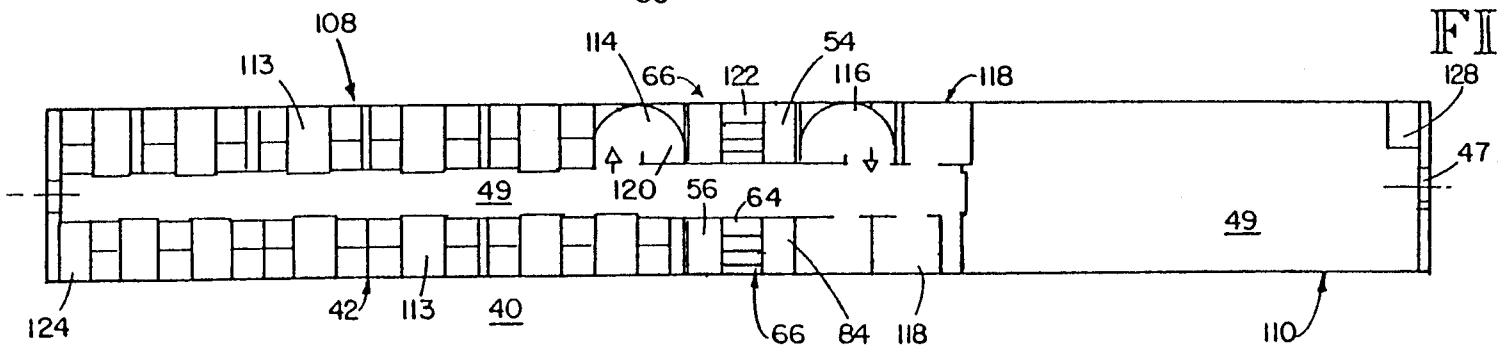
FIG. 9 is a cross-sectional view taken along lines 9—9 of the lower level of the kitchen and dining room car according to the present invention.

The general layout of the floors of railroad cars 40 and 84 is illustrated in FIGS. 9–11. The lower level of car 40, as illustrated in FIG. 9, has a dining room section 108 and a kitchen section 110. The dining room section 108 includes a plurality of seats 112 and a plurality of tables 113 at which the passengers may sit and eat meals while traveling in the railroad car. The lower level 42 includes semicircular stairwells 114 and 116 to the upper level of car 40. Doorway 66 opens to stair 64 to permit entrance from the ground level to the railroad car from the side. Appropriate bathroom facilities 118 are also provided. A kitchen area 110 is located at the end of the car which couples to car 84. The kitchen area includes the necessary stoves, ovens, and other equipment for preparing and serving food. Doorway 47 opens from the kitchen area into the floor region 87 of the railroad car 84 when the cars are coupled together. The lower level includes six air-conditioning units 54, 56, 120, 122, 124, and 128. Air-conditioning units 54, 56, 120, and 122 serve the upper level 44 of car 40. Air-conditioning units 124 and 128 serve the lower level of car 40. The air-conditioning units as shown include not only the forced fans and compressors but also some of the duct work necessary to couple the flow of air from the fan to the duct within the railroad car. A significant portion of the air-conditioning units are coupled to the frame of the train below the frame in the area under the railroad car, as previously described.

The lower level 86 of car 84 is shown in FIG. 10. The lower level 86 of car 84 is similar in many respects to car 40 in that it includes a plurality of seats 112 and table regions 114 serving as a dining room area for the passengers. Similarly, semicircular stairwells 114 and 116 couple the lower level to the upper level and doorways 66 open to stairways 64 to permit passengers to enter and exit. Appropriate restrooms 118 are provided. A doorway 130 opening to the floor region 87 of car 84 is located at the end of the car 84, which is coupled to the car 40. With doorway 130 open, a passageway 106 is formed, coupling the floor regions of the two cars together at the lower level. Service personnel, such as cooks, waitresses, and the like, can serve the people in dining rooms of car 40 and car 84 with equal ease. Further, passengers may walk from one car to the other using the upper level without walking through the kitchen or disturbing people either serving or eating in the dining rooms. Doorways 138 and 130 are greater than 24 inches in width and greater than 70 inches in height to permit people to easily pass through the passageways formed between the cars.

Open-platform region 98 is located towards the rear of the railroad car. Passengers may stand at the open-platform area to view the passing scenery, feel the wind in their faces, and the like. Six air-conditioning units 132–137 are provided in the car 84, air-conditioning units 132–135 providing the cooling for the upper level and air-conditioning units 136 and 137 providing the cooling for the lower level.

The upper levels of the railroad cars are substantially similar to each other. The upper levels include stairwells 114 and 116 opening to the lower levels to permit passengers to move up and down between levels. The upper level includes a plurality of seats 140 and coffee tables or recreation areas 142 for use by the passengers. The upper level 88 of car 84 contains a doorway 138 opening into the floor region of the upper level at the end which couples to the car 40.

The railroad cars include seats 140 positioned on stepped region 142, as shown in FIGS. 7, 8, and 12. The vertical window portion 72 serves to increase the viewing area of the passenger, while providing significantly more head room. In prior art cars with a window having a constant radius of curvature, if the window is raised to provide more head room, the view of the passenger is restricted. If the window is lowered or the seat raised, the passenger's head may abut the glass. By using an integral glass panel as part of the side wall and ceiling, having a curve therebetween, the passenger is provided both a good view and plenty of head room, as can be seen from FIG. 7. The stepped region 142 is positioned directly above the forced air ducts 144 used for the ar conditioning and heating of the railroad cars. The step 144 is relatively short, approximately four inches. The step is therefore an easy step up for the passengers into the area of the seats 140, as shown in FIG. 8. The step 142 may be eliminated completely by lowering the forced-air ducts 144 or decreasing their cross-sectional area.

Figure 13:
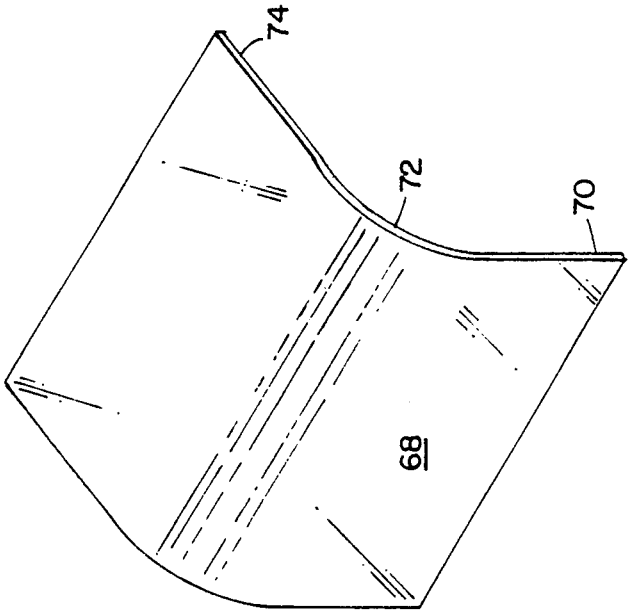
FIG. 13 is an isometric view of the window of the upper level according to the present invention.
Figure 14:
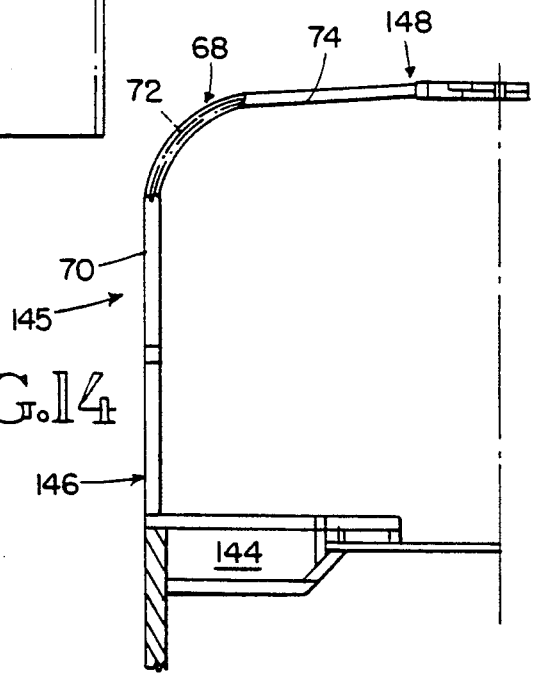
FIG. 14 is a cross-sectional view of the upper level and window according to the present invention.

The windows of the observation deck include a generally vertical portion 70, a curved portion 72, and a generally horizontal portion 74, as shown in FIGS. 12–14. The vertical portion 72 is coupled through an appropriate sealing member to opaque sidewall 146, as shown in FIG. 14. The window 68 is an integral member comprising portions 70, 72, and 74. The window 68 is transparent and preferably made of a plurality of integral layers of glass appropriately coupled or fused together and having the desired antireflection and thermal properties. The window 68 may be made of plastic or some other material, if desired, though glass is preferred. The vertical portion 70 of glass 68 forms part of the sidewall 145 of the upper level of the railroad cars. The glass curves at portion 72 along a desired radius of curvature. Straight portion 74 generally extends horizontally to form a portion of the ceiling 148. The portion 74 is not perfectly horizontal but rather extends upward at an angle alpha with respect to the horizontal. Preferably, the angle alpha is in the range of 5–10 degrees, though it could be more or less if desired. In an alternative embodiment (not shown), the angle alpha is approximately zero and the straight portion 74 extends more horizontally. In the embodiment in which the angle alpha is greater than zero, the angle between the vertical portion 70 and the generally horizontal portion 74 is greater than 90 degrees.

The air-conditioning and duct system of the railroad cars is designed to provide the desired cooling rate as required by the cars while traveling. The upper level 88 of the railroad car becomes significantly hotter than the lower level 86 of the same car. The upper level becomes hotter because heat rises and also because of the large window surface area. Four air-conditioning units are provided for the upper level of each car, whereas only two air-conditioning units are required for the lower level of each car, located as previously shown and described.

Figure 15:
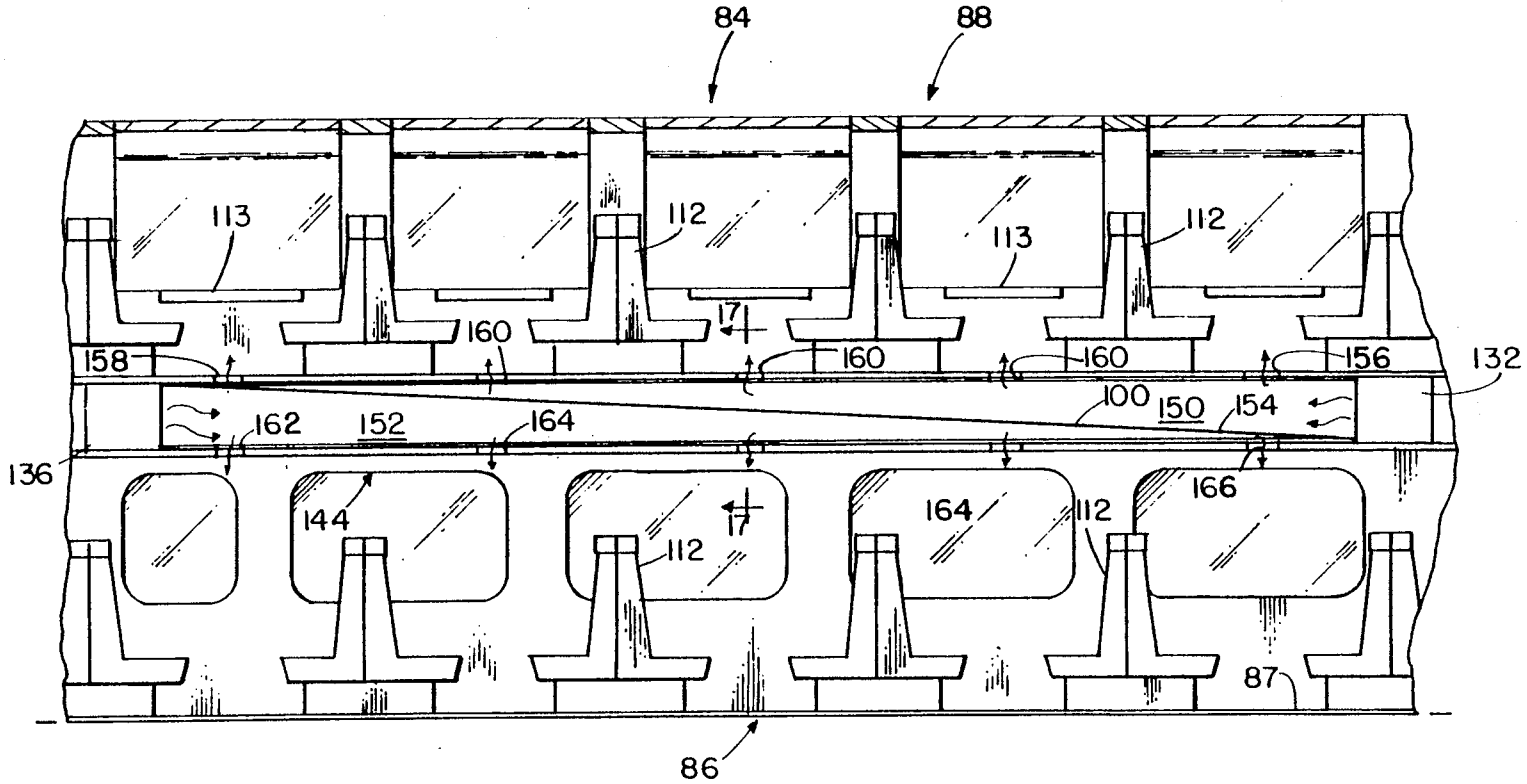
FIG. 15 a schematic view of an air-conditioning system according to the present invention.
Figure 16:
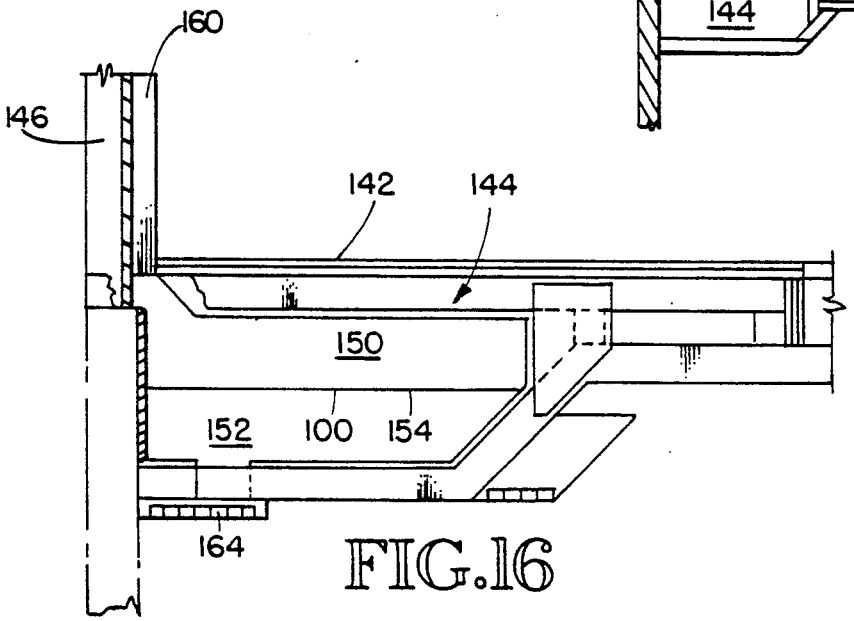
FIG. 16 is a cross-sectional view taken along lines 16—16 of FIG. 15 of the air-conditioning duct according to the present invention.

An enlarged schematic view of the forced-air duct system of the railroad cars is illustrated in FIGS. 15 and 16. The forced-air main duct 144 includes separate ducts 150 and 152 servicing the upper and lower levels of each quarter of the railroad car. The system as shown in FIG. 15 is only one side of one-half of the railroad car, and additional duct systems similar to that shown in FIG. 15 are used throughout the railroad car as required. The main duct 144 is separated into two independent and separate ducts 150 and 152 by partition 154. Duct 150 has a significantly larger cross-sectional area adjacent air-conditioning unit 132 than at the regions spaced from the air-conditioning unit 132.

One problem of prior art air-conditioning systems, particularly in railroad cars, is the uneven distribution of forced air throughout the railroad car. In the prior art, the forced-air ducts had uniform cross-sectional areas along their entire length and vents permitting air to exit into the passenger region. As air in the prior art duct is forced into the duct at one end thereof, air exits from the closed vents first. Significantly more air was forced out of the vents located closer to the fan than out of the other vents. The vents at the far end of the duct, located away from the fan, had little or no air exiting from them, as it had already exited out of the closer vents. Because the vents located closer to the fan of the force-air unit passed significantly more air, the passengers adjacent the ducts would be much cooler, or, if heated air were being forced, much hotter than passengers sitting adjacent vents located at the far end of the duct. Consequently, some passengers in the railroad car would be excessively chilled and request that the air-conditioning system be turned down or off, while other passengers, connected to the same air-conditioning system, would be excessively hot and would request that the air conditioning be increased.

A forced-air duct 150 according to the invention has a varying cross-sectional area along its entire length. The cross-sectional area is greatest where air enters the duct and gradually decreases to a very small area at the end of the duct farthest from the forced-air unit. The slope of the partition 154 is selected to ensure that generally the same quantity of air exits from vents 156 adjacent the air-conditioning unit as exits from vents 158 spaced at the other end of the duct from the air-conditioning unit. Similarly, the same amount of air exits from vents 160, located near the center of the duct 150. The cross-sectional area of the duct 150 is decreased corresponding to the number and size of the vents and quantity of air flowing out of the vents. If the vents are uniformly spaced along the duct, as in the example of FIG. 15, the duct gradually and uniformly decreases in cross-sectional area to provide the desired effect. However, if the vents are spaced nonuniformly along the duct or it is desired to have more air exit from some vents than others, the cross-sectional area of the duct 150 may be selected at each region to provide the desired quantity of air exiting from the vents. Using a duct with a varying cross-sectional area permits the airflow out of the vents spaced along the duct to be uniformly controlled without the need of opening or closing vent members at the respective vents. Small variations between the amount of air existing at each vent may exist, but these variations are small compared to those permitted by the prior art.

The duct is particularly suitable for railroad cars which require that air be uniformly distributed both laterally along the length of the car and vertically in a compact duct system. Air-conditioning unit 136, serving the lower floor, is coupled at the opposite end of duct 41 as air-conditioning unit 132, serving the upper level. The partition 154, dividing the duct 144 into two separate ducts, provides a duct having a large cross-sectional area at one end and a second duct, having a large cross-sectional area at the other end thereof. The forced air entering the duct 152 of main duct 144 is uniformly distributed through appropriate vents 162 located close to the air-conditioning unit 136, vents 164 located centrally within the duct 152, and vents 166 located at the far end of the duct 152 away from the air-conditioning unit 136. The sum of the cross-sectional areas of the ducts 150 and 152 is a constant, which permits the ducts to be placed overlapping each other to provide a compact duct system for distributing forced air throughout the railroad cars. Because the upper level of the railroad cars is significantly hotter than the lower levels, a single air-conditioning unit 132 serves one side of the car while a dedicated air-conditioning unit serves the other side of the car. However, the air-conditioning unit 136 is connected through appropriate duct work to both sides of the lower level to feed parallel ducts 152 on the lower level.

The air in duct 150 is channeled along the sidewall 146 to exit at vents 160, as shown in FIG. 16. The air in duct 152 is channeled to exit through vents 164.

Another problem of prior art duct systems in railroad cars is the room taken up by the ducts. Any room taken up by the ducts encroaches into the space available to the passengers. In the prior art, each duct was fed from only one end. Further, the ducts, having the same cross section along their entire length, took up considerable room, even though they were not very efficient. Small volumes of air flowed through the large ducts at the end away from the fan.

The present invention provides twice the air cooling capacity in the same space or even less space than the prior art devices, with significantly more efficient cooling throughout the car. At the duct end near the fan 136, where large volumes of air must pass, the duct 152 has a large cross-sectional area. As air exits through the vents, thus decreasing the volume of air that must pass through the duct 152, the duct decreases in cross-sectional area. The duct's decrease in area is based on the flow of air out of the vents along its length to provide generally uniform air pressure along the duct 152. At the end of the duct 152, where only the amount of air needed to exit out of the last few vents is present, the area of the duct has decreased to be very small. Near the last vent 166, the duct terminates with a very small cross-sectional area. Duct 150 similarly decreases in area along its length. The large end of the duct 152 is positioned adjacent the small end of duct 150. The large end of duct 150 is positioned adjacent the small end of duct 152. As the duct 152 decreases in area, the duct 150 increases, and vice-versa. Two ducts 150 and 152, each providing full cooling capacity for the respective upper and lower sections of the car, fit into the same area of a single duct in the prior art. Positioning the ducts with their respective fans at opposite ends of the main duct 144 furnishes the advantage of a more compact duct system, one-half the size of similar prior art systems, providing the same cooling capacity in a more efficient manner. A small step up 142 is permitted, as shown in FIG. 8, without encroaching upon the headroom of the lower level of the seating area of the upper level.

While the invention has been described with respect to a double level railroad car on a flat center sill, it will be apparent to those in the art that many features of the invention, such as the forced-air duct system, may be used in buses or known railroad cars. Further, many different structures may be used to provide the same advantages of the invention in the same way and fall within the scope of the invention.

I claim:

1. A railroad car apparatus comprising:

a first railroad car having a first end and a second end and having wheels at each end adapted to contact a pair of rails below said railroad car;

a frame of said first railroad car including a center sill, said center sill extending generally horizontal between support points above said wheels at said first end of said railroad car to wheels at said second end of said railroad car;

a first floor region positioned above said center sill of said first railroad car;

a first doorway opening into said first level floor region at said first end of said first car;

a second floor region positioned above said first floor region of said first railroad car;

a second doorway opening into said second level floor region at said first end of said first railroad car;

a second railroad car coupled to said first railroad car, said second railroad car having a first end and a second end and having wheels at each end adapted to contact a pair of rails below said second railroad car;

a frame of said second railroad car including a center sill, said center sill extending generally horizontally between support points above said wheels at said first end of said second railroad car to wheels at the second end of said second railroad car;

a first floor region positioned above said center sill of said second railroad car;

a first doorway opening into said first level floor region at said first end of said second railroad car;

a second floor region positioned vertically above said first floor region;

a second doorway opening into said second level floor region at said first end of said second car, said second railroad car being coupled at its respective first end to said first railroad car at its respective first end, coupling the floor regions of said cars together at said first level, thus forming a first common passageway between said first and second railroad cars at respective first floor regions; and a second common passageway between said first and second railroad cars at respective second floor regions being formed, permitting different users to pass from said first railroad car to said second railroad car at said first passageway or at said second passageway independent of each other.

2. The apparatus according to claim 1 wherein said first railroad car includes a row of seats on said first floor region and a row of seats on said second floor region.

3. The apparatus according to claim 1 wherein said second railroad car includes a wall coupled to said first floor region, said wall having a doorway therein, said wall being spaced from a second end of said second car, said second railroad car having an open platform area between said wall and said second end.

4. The apparatus according to claim 3 wherein said open platform extends for over 20 percent of the length of said railroad car.

5. The apparatus according to claim 3 wherein said open platform extends for approximately 20 percent of the length of said railroad car.

6. The apparatus according to claim 1 wherein said first railroad car includes a plurality of windows coupled to a sidewall member, said windows having a first straight portion extending generally vertical, a curved portion and a second straight portion extending generally horizontal at an angle with respect to said first straight portion.

7. The apparatus according to claim 5 wherein said angle is greater than 90 degrees.

8. The apparatus according to claim 6, further including a pair of seats, each having a back and a seat portion adapted for passengers to sit therein facing each other, a table between said seats at said second floor region and a single, one-piece window of said plurality of windows extending generally from said back of one of said seats to the back of the other of said seats within said pair to provide a large viewing field for passengers sitting in said pair of seats.

9. The apparatus according to claim 6, further including a seat coupled to said second floor region having a back, said window extending as a single, one-piece transparent member from a position below said back, over the head of a passenger riding in said seat, and terminating generally at a center region of said first railroad car.

10. The apparatus according to claim 1, further including a main duct positioned between said first and second floors of said first car; a partition member positioned within said main duct forming a first and second duct within said main duct, said partition member being sloped from a first end of said main duct to a second end thereof, said first duct having a larger cross-sectional area at said first end than at said second end thereof and said second duct having a larger cross-sectional area at said second end than at said first end.

11. The apparatus according to claim 10 wherein said main duct has a generally uniform cross-sectional area for its entire length.

12. The apparatus according to claim 10 wherein said partition member is sloped at a constant angle along its entire length thereof.

13. The apparatus according to claim 10, further including a pair of air conditioning units, one coupled to each of said ducts at the end having the larger cross-sectional area.

14. The apparatus according to claim 1, further including a kitchen area in said first car floor region adjacent the first end of said first car which is coupled to said second car to permit kitchen personnel to walk from said first car to said second car at said first floor region simultaneously with passengers walking from said first car to said second car at said second floor region.

15. A touring vehicle comprising:

a plurality of axles coupled to said touring vehicle;

a plurality of wheels rotateably coupled to said axles to permit said touring vehicle to easily move;

a floor region coupled via a frame to said axles;

a plurality of seats coupled to said floor region, said seats being arranged in pairs, each seat having a back portion and a seat portion adapted for passengers to sit therein facing each other;

a table between each pair of said seats; and an integral one-piece transparent member having a generally vertically extending portion adjacent said pair of seats, a curved portion bending inward over said pair of seats and a generally horizontally extending portion extending over said pair of seats, said integral, one-piece transparent member extending generally from said back of one of said seats of said pair to the back of the other of said seats within said pair, said transparent member having a bottom region positioned approximately adjacent to the surface of said table to provide a single, large viewing field for passengers sitting in said pair of seats, the viewing field extending from the table top upwards towards the center of the car and from the back of each seat of said pair forward to the seats facing each other providing the passengers with a clear, unobstructed view out of said touring vehicle from a position approximately at the back of their heads forward and from below a central body portion, from below the shoulder region upward such that said passengers are able to see the passing scenery and remain generally in the seated position.

16. A touring vehicle comprising:

a plurality of axles coupled to said touring vehicle;

a plurality of wheels rotateably coupled to said axles to permit said touring vehicle to easily move;

a floor region coupled via a frame to said axles;

a ceiling region;

a wall region;

a plurality of seats coupled to said floor region; and an integral, one-piece transparent member extending as a single member from a position adjacent a torso region of a passenger sitting in one of said seats to said ceiling region, said single transparent member having a bottom region forming a portion of said wall adjacent a torso region of said passenger, said window having a bottom end being below a shoulder and mid-chest region of said passenger and extending as a single transparent member from said bottom end to said ceiling region to provide an unbroken view of the countryside from said single, transparent member.

17. The touring vehicle according to claim 16 wherein said bottom end is approximately at the waist region of the torso of said passenger.

18. The touring vehicle according to claim 16 wherein said integral, one-piece transparent member includes a generally vertically extending portion adjacent said seats and forming a portion of said wall region, a curved portion bending inward over said seats, and a generally horizontally extending portion extending over said seats to form a portion of said ceiling region.

* * * * *

UNITED STATES PATENT AND TRADEMARK OFFICE

CERTIFICATE OF CORRECTION

PATENT NO. : 5,063,859

DATED : November 12, 1991

INVENTOR(S) : Thomas G. Rader

It is certified that error appears in the above-identified patent and that said Letters Patent is hereby corrected as shown below:

In column 10, claim 7, line 58, please delete "claim 5" and substitute therefor -- claim 6 --.

Signed and Sealed this

Sixteenth Day of March, 1993

*Attest:*

STEPHEN G. KUNIN

*Attesting Officer*

*Acting Commissioner of Patents and Trademarks*